US005418990A

United States Patent [19]

Risåsen

[11] Patent Number: 5,418,990

[45] Date of Patent: May 30, 1995

[54] OPERATION TABLE

[76] Inventor: Borge Risåsen, Heggveien 15A, N-1481 Hagen, Norway

[21] Appl. No.: 108,684

[22] PCT Filed: Mar. 6, 1991

[86] PCT No.: PCT/NO91/00035

§ 371 Date: Sep. 3, 1993

§ 102(e) Date: Sep. 3, 1993

[87] PCT Pub. No.: WO92/15272

PCT Pub. Date: Sep. 17, 1992

[51] Int. Cl.[6] ..... A61G 13/04; A61G 13/06; A61G 13/08

[52] U.S. Cl. ..... 5/608; 5/607; 5/611; 5/619

[58] Field of Search ..... 5/608, 607, 610, 600, 5/619, 611

[56] References Cited

U.S. PATENT DOCUMENTS

| | | | |
|---|---|---|---|
| 2,239,821 | 4/1941 | Knox . | |
| 3,302,218 | 2/1967 | Stryker . | |
| 3,827,089 | 8/1974 | Grow . | |
| 4,356,577 | 11/1982 | Taylor et al. | 5/608 |

FOREIGN PATENT DOCUMENTS

| | | | |
|---|---|---|---|
| 2041291 | 4/1969 | France . | |
| 2556588 | 12/1983 | France . | |
| 2585240 | 1/1987 | France . | |
| 8703029 | 2/1989 | Sweden . | |
| 8904650 | 6/1989 | WIPO | 5/608 |

*Primary Examiner*—ALexander Grosz
*Attorney, Agent, or Firm*—Patterson & Keough

[57] ABSTRACT

An operating table, universally applicable for all types of operations, is based on a column (1) which constitutes a support for a two-part bed, with the parts "bed A" and "bed B", each of which is attached to its part of a ring (2) which can be rotated through 360° in the horizontal plane in a bearing unit (3). The bearing unit (3) is arranged on a vertically rotatable device (14) on the supporting vertical column (1) which is designed so that the axis of rotation coincides with the patient's vertical centre of gravity. The patient can thus be rotated in the vertical plane. Thus the patient's rotations coincide with the patient's horizontal and vertical centre of gravity, enabling the patient to be rotated into the required position with a minimum of effort. It will thus be possible to gain access to the operating table from all sides, and there will be a choice between "bed A" and "bed B", with the patient lying on his stomach or on his back.

9 Claims, 10 Drawing Sheets

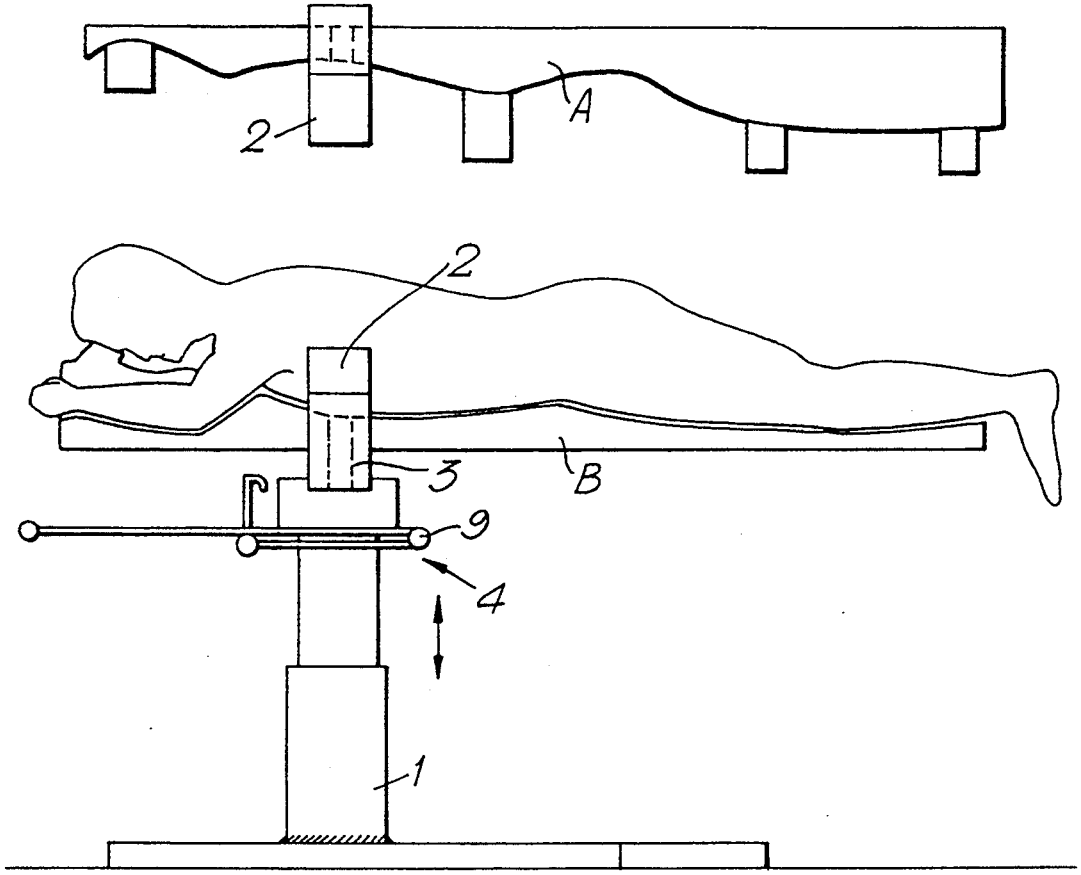
Fig. 6.
Fig. 7.
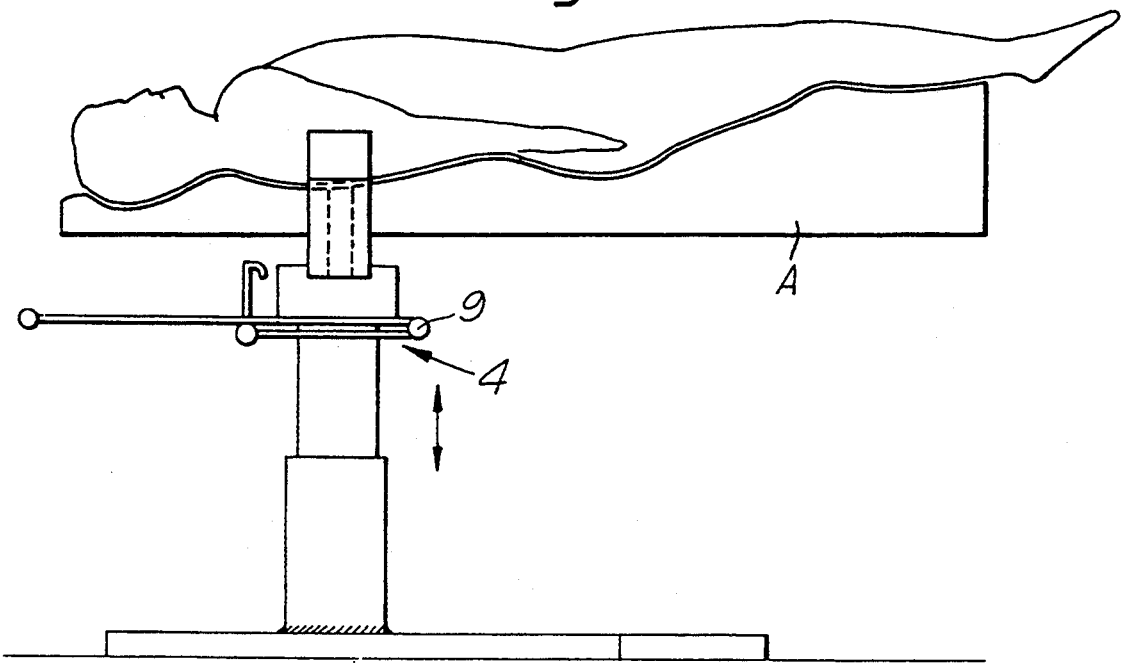

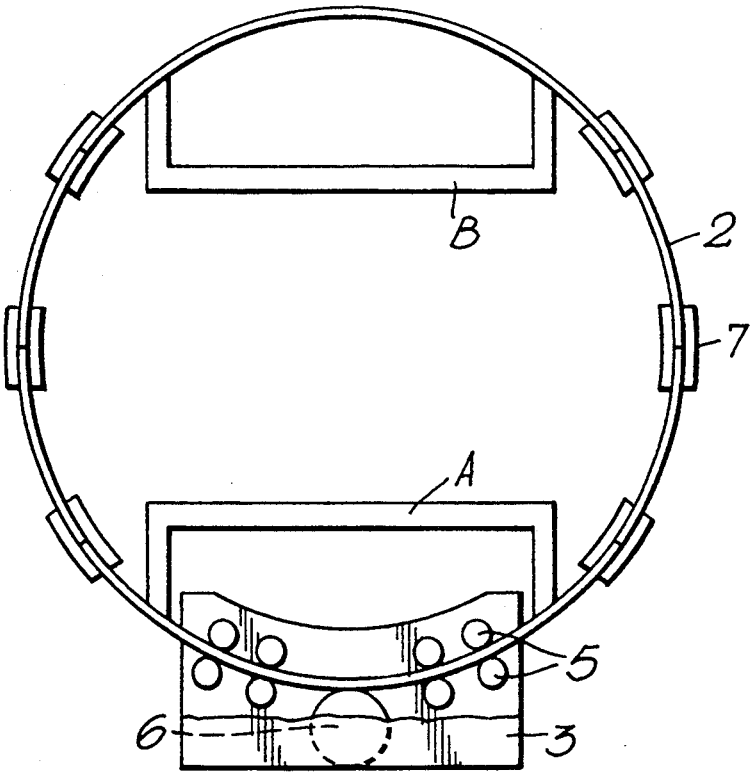
Fig. 11.
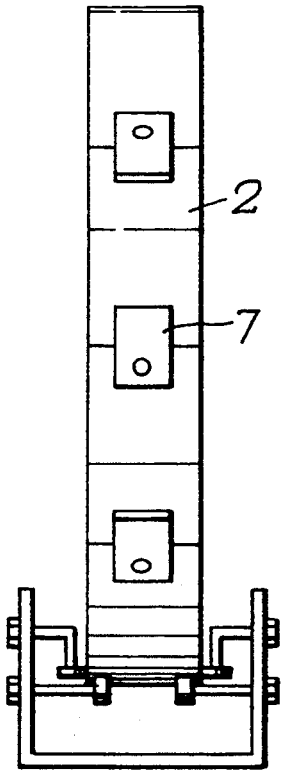

OPERATION TABLE

FIELD OF THE INVENTION

The invention concerns an operating table comprising a telescopic supporting column on which is mounted a support device with rotating mounting for a divisible, rotatable ring in which are mounted one above the other two beds for a patient to lie on where the beds with their support device are rotatable in the vertical plane.

BACKGROUND OF THE INVENTION

There are a number of known devices for enabling the turning and movement of an operating table on which a patient who is to be operated on is lying. Particularly in the case of back operations and brain operations, but also for some other types of operations it may be vital to be able to place the patient in exactly the right position, with the correct curvature of the back or at a particular angle for the best possible angle of incidence to the operating site. It can also be important to be able to tilt the patient during the operation in order to avoid vomiting and nausea. Furthermore, it is important to be able to turn the patient when the patient's head has to be facing upwards for the administration of the anaesthetic, while having to turn him afterwards in the case of, e.g., a back operation, a task which can involve the personnel in some fairly hard work. Moreover, there can be problems if a badly injured person has to be lifted on to a table while simultaneously having to be careful to move him as little as possible.

This problem has led to the development of a number of different variants of revolving and rotating operating tables. Thus, for example, from French patent No. 2,585,240 there is a known operating table's support column with a ring-shaped element into which an operating table or bed can be introduced and where an opposite bed is permanently mounted in the ring. By securing the patient between these beds, the ring can then be turned and the patient moved into the required position. However, this device is relatively awkward to use and the ring may get in the way during the operation.

Moreover, from U.S. Pat. No. 3,302,218 a further device with a rotatable ring is known in which a bed is used. The ring is in two parts with a hinged connection enabling it to be opened. When a patient has to be turned after he has been lifted on to the bed, the ring is opened and a second bed is placed over the patient to secure him, after which the ring is turned 180 degrees, the ring is opened and the patient can be released from the upper bed. This device is limited to one rotation of 180 degrees and in this design too the ring will be in the way.

From Swedish patent application No. 8703029 a further solution is known based on the ring principle. Here two rings are used which are mounted on a stand and these rings can be split into several segments. Inside the ring are fitted four beds, enabling a patient to be turned 90 degrees or placed in a corner between two beds. During the operation the upper part of the rings is removed, thus achieving considerably better access to the patient during the operation. This arrangement, however, severely limits the possibility of vertical or oblique movement and due to the use of two rings it will not be possible to place the patient in any kind of substantially bend position or to have his knees at an angle, etc.

In conclusion we refer to Norwegian patent application No. 87 4921 which describes a rod device which projects from a support column and in which the rods are supplied with joints which enable a patient holding device to be rotated completely in the vertical direction and 180 degrees in the horizontal direction. This device offers a large range of possible positions for the patient during the operation and with the device described in the Norwegian application it is also possible to place the patient in bent positions. Even although the axis of rotation for moving the operating table or the patient is approximately in the patient's centre of gravity, the system is not completely balanced and when using the above-mentioned joint mechanisms, electrical or motor drive, and thus a control of the system will be required. A further disadvantage of this known device is that the patient in the horizontal plane can only be rotated 180 degrees, which means that some positions cannot be achieved and can result in longer paths of movement than are desirable.

To sum up briefly, therefore, the problem which forms the basis for the invention is to provide a device which makes it possible to achieve any conceivable position for the patient in an operation situation, in that account should be taken of the fact that there are many details which have to be correct, so that even a "millimetre adjustment" may be necessary. In this connection it should also be possible to adjust or position parts of the body in required positions independently of one another and to obtain, e.g., bending of a back. These fine adjustments of position before or during an operation should be possible in all directions. Furthermore, it should be possible, e.g., if necessary to be able to tilt the patient with his head forward in order to avoid vomiting etc.

Moreover, it should be possible to have an injured person transferred to the operating table with as few movements as possible and to have him turned into required positions. The same applies when a patient has to be returned to bed after an operation, when it is desirable for the transfer to be made as directly as possible. This also applies, e.g., to transfer to a chair, in that it may be vital for the patient to be exposed to minimal movement. These conditions are not met in either of the above-mentioned French or American patents, nor the device in accordance with the Swedish application. In the case of the embodiment according to the Norwegian application, such a transfer of a patient would be possible, but the handling of the patient on the actual operating table is, as already mentioned, not completely satisfactory.

The object of the invention is therefore to satisfy the above-mentioned requirements as fully as possible. This object is achieved by an operating table characterized by the features in the claims presented.

The invention has thus succeeded in satisfying all the above described strict requirements with regard to handling of a patient before, during and after an operation at one time. This is not possible with the above-mentioned known techniques.

SUMMARY OF THE INVENTION

The invention has made a rotation of 360 degrees in the horizontal plane possible and provides extremely satisfactory movements for laying on and lifting off the patient in the vertical direction. By means of the specially preferred embodiment of the invention it is even possible to achieve a rotation of 360 degrees both in the horizontal and the vertical planes.

In the following section the invention will be described in more detail by means of embodiments which are represented in the drawings, which illustrate in a purely schematic way.

DETAILED DESCRIPTION OF THE PREFERRED EMBODIMENT

Figure 1:
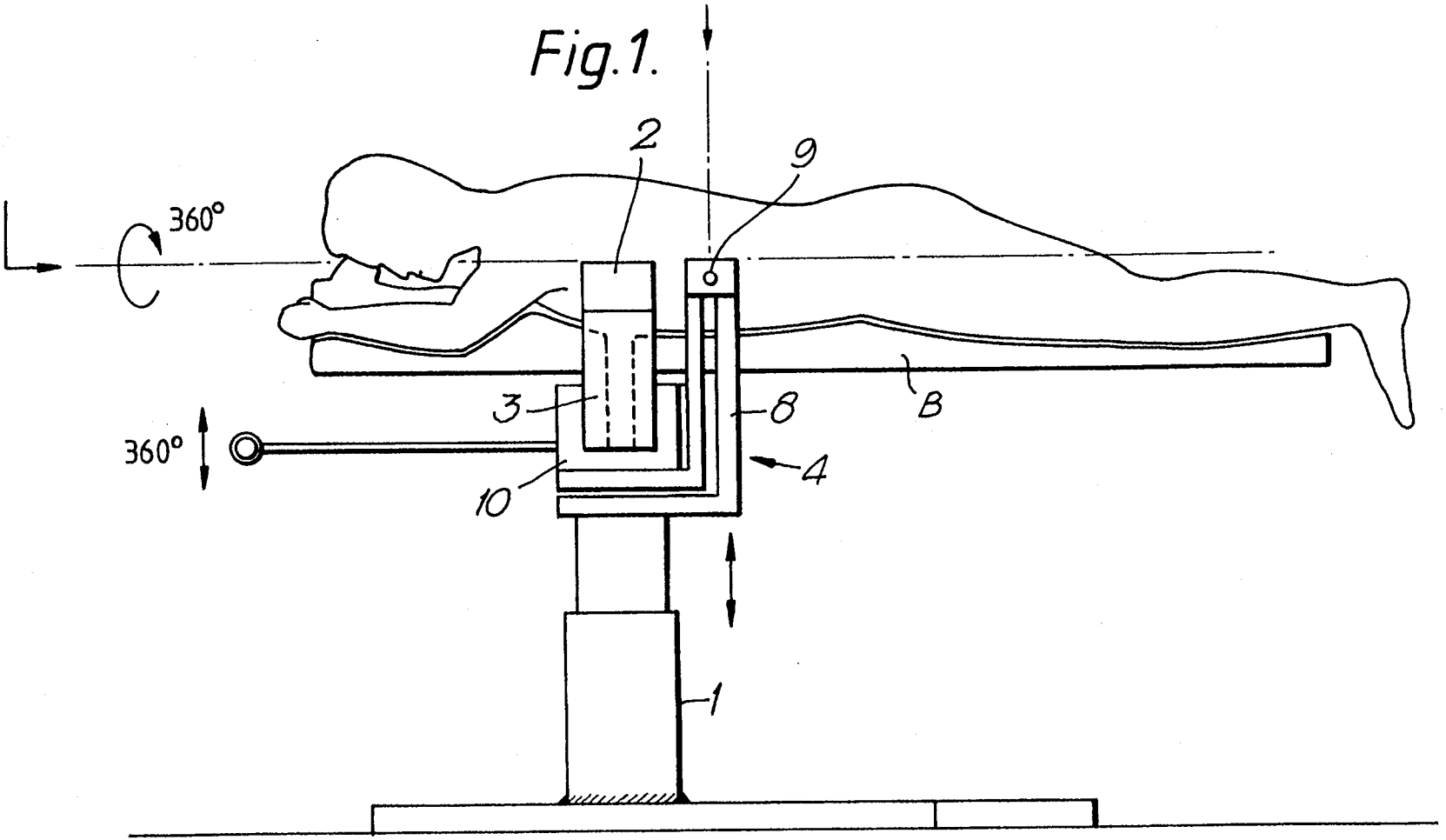
FIG. 1 is a first embodiment of the invention in a side view with the patient face down in a horizontal position, FIG. 2–4 the embodiment in FIG. 1 viewed from the end, in three different positions, in a slightly modified version, FIG. 5 a sketch corresponding to FIG. 1, but of another embodiment of the invention, FIG. 6 a sketch corresponding to FIG. 5, but with both parts of the rotation ring, and both beds included, FIG. 7 the embodiment in FIG. 5, but with the patient turned, FIGS. 8–10 end view corresponding to FIGS. 2–4 illustrating three different positions, FIG. 11 detail sketch showing a rotation mounting for ring elements, FIG. 12 a sketch illustrating a position in which the patient can be placed on the operating table, FIG. 13 an end view illustrating a third embodiment of the invention, FIG. 14 a corresponding sketch illustrating a fourth embodiment, and FIG. 15 an illustration of the use of the mechanism for fine adjustment of the operating table.
Figure 2:
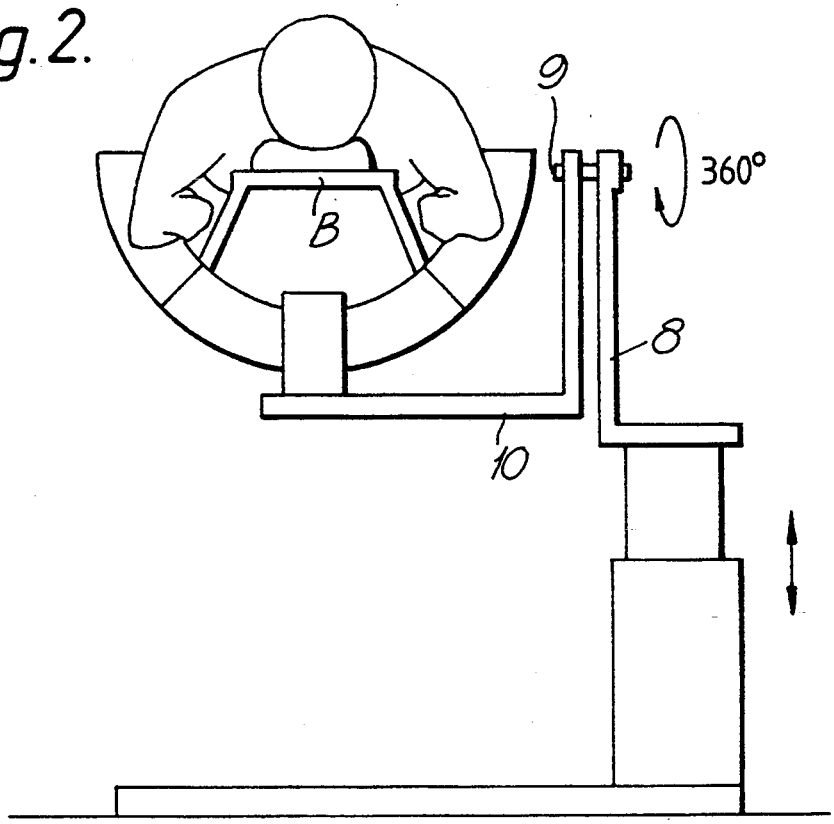
Figure 3:
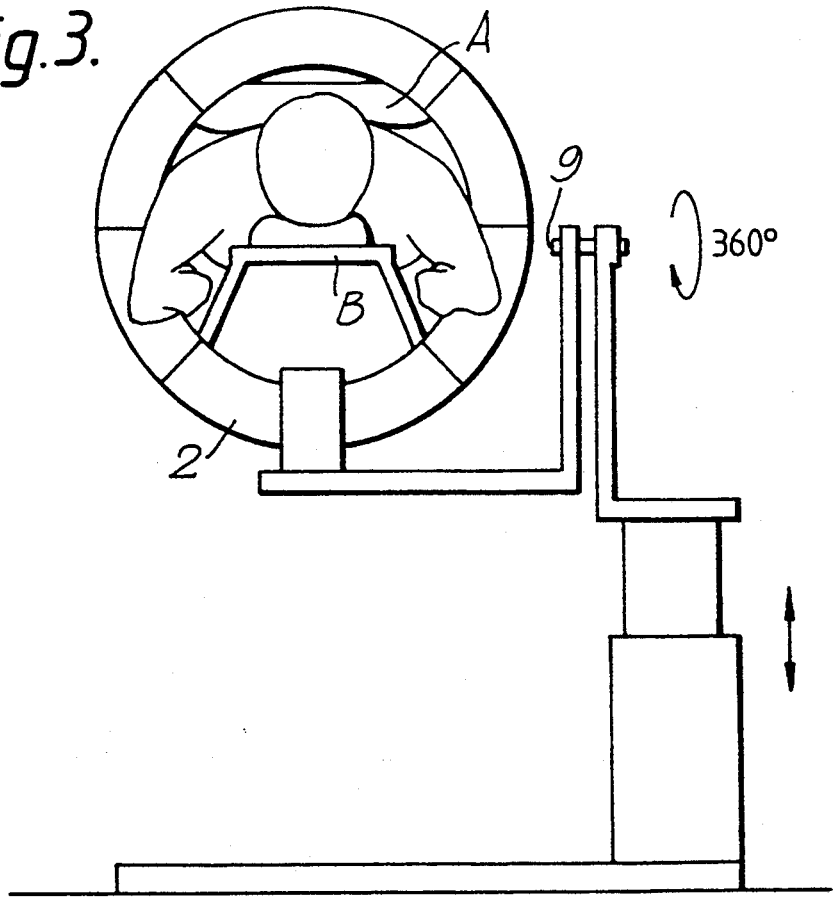

FIGS. 1–4 illustrate a first, preferred embodiment of the invention. The operating table consists of a telescopic, support column which enables the table to be raised and lowered and on which is placed a support device which is generally indicated by 4, on which is mounted a divisible, rotatable ring, of which only one half is illustrated in FIG. 1. The whole ring is shown in FIG. 3. The ring is mounted in a rotating mounting 3 which is situated on the support device 4. In this ring, i.e. in each half of the ring 2 is fitted a bed for a patient to lie on, a bed B in one half, as illustrated in FIG. 1 and in the opposite half of the ring base A as illustrated in FIG. 3. This design of the rotatable ring with bed is common to all the figures, and all embodiments. In reality the embodiments are distinguished from one another mainly by different variations of the support device 4.

Figure 4:
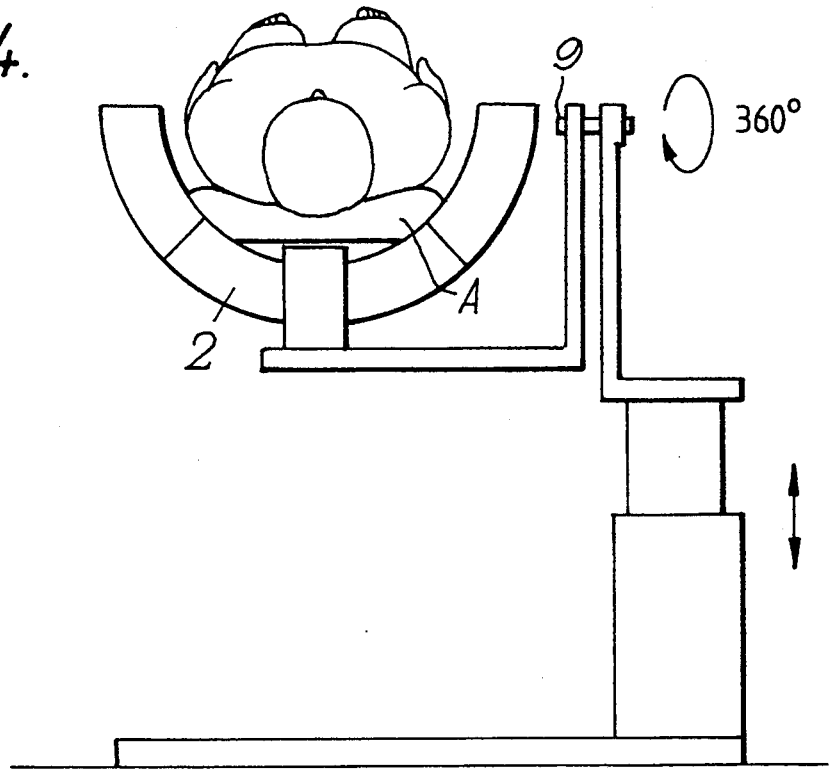
Figure 12:
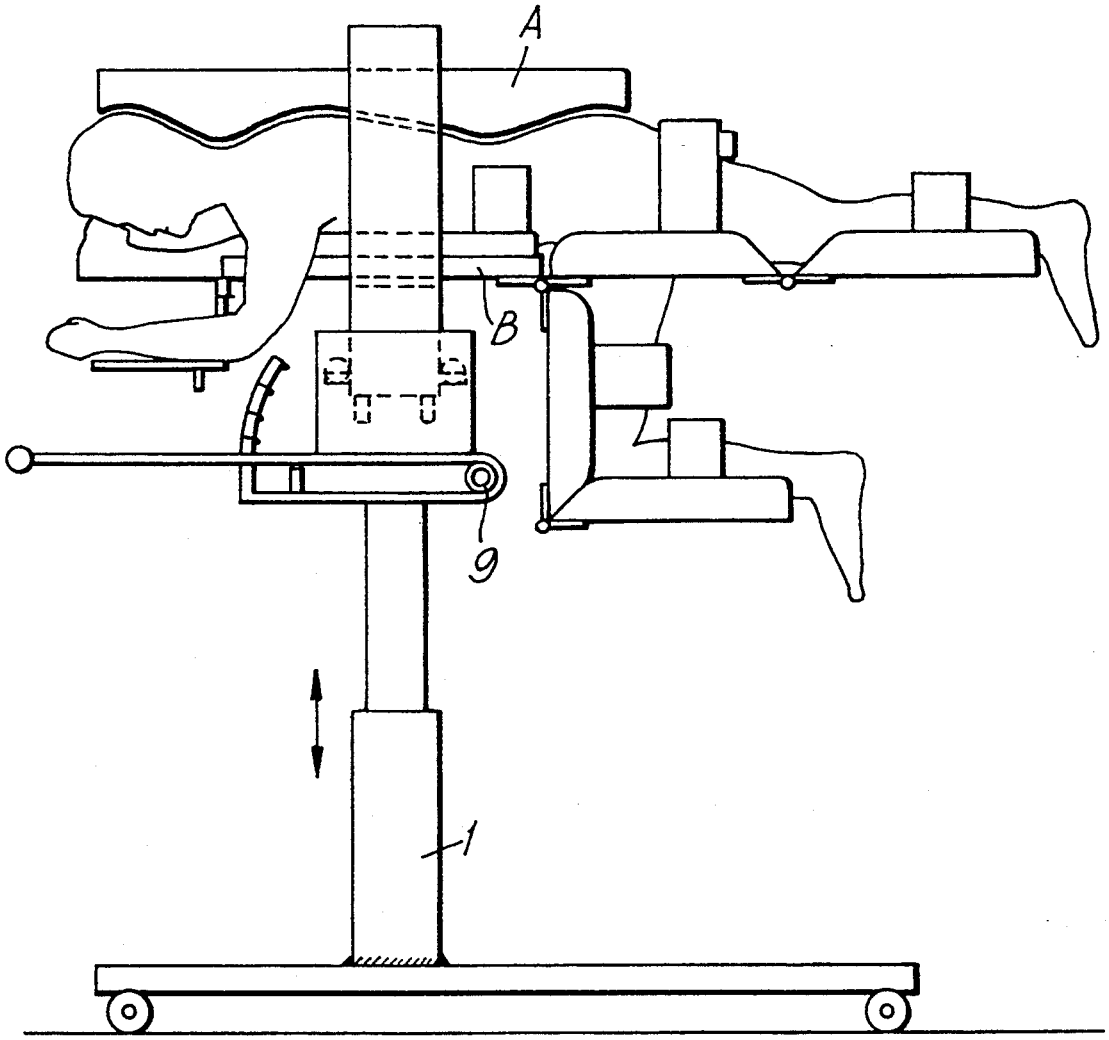

When a patient is to be operated on, he is laid, e.g., on a bed A which is turned down by an appropriate rotation of the ring while part B is removed, as illustrated in FIG. 4. In this position the patient can be anaesthetized, after which the other half of the ring with base B is connected to the first half of the ring as illustrated in FIG. 6. Thereafter, the ring can be turned manually in the rotating mounting 3 from a position where the patient is lying with his back down until he is lying with his back up or he can be placed in any intermediate position by rotating both to the right and to the left so as to move him into the most favorable position for the operation. As already mentioned, FIG. 3 illustrates how the patient is placed in such a position with his back up and FIG. 2 shows the position ready for the operation with free access to the back. If it is necessary for the patient to bend one or both legs, e.g. as illustrated in FIG. 12, at least one of the beds A or B is designed with joints which enable this kind of angular position to be achieved. FIG. 12 illustrates that the patient can be placed in many different positions while it is still possible to rotate him in the ring to any intermediate position. As already mentioned such a rotation can be performed in all directions and finely adjusted to exactly the right position. The beds must be adapted correspondingly, e.g. as a shorter carapace.

FIG. 11 illustrates a design for the ring with its rotating mounting. The rotating mounting can, e.g., consist of a number of rollers 5 mounted in one set, which locates and controls the movements of the ring. The actual movement or rotation of the ring can be performed by means of a large set of rollers which, e.g., can be turned both ways from the outside. There are many possible modifications here. The securing elements for the ring can be conventional hooks which are arranged in the middle section of the ring as illustrated in the figure on the right. In this figure there are also indicated side support rollers which are not shown in the figure on the left. The hooking mechanism 7 will therefore not be in the way of the mounting and any drive rollers, thus allowing the wheel to rotate freely.

If patients have to be operated on who are of a size which requires a greater distance between bed A and bed B, distance pieces can be inserted between the two halves in order to increase the distance between the beds. The insertion of such distance pieces should not cause any problems for the craftsman and thus no further description is given. It is only necessary to ensure that the mounting is constructed with its rollers in such a way that the distance pieces can be inserted without affecting the rotational capacity of the ring. Removal of distance pieces can also cause the remaining half ring to become lower, thus facilitating access to the patient.

The objective of the invention is to combine the good possibilities for adjusting the patient by rotation around the patient's horizontal axis in a recumbent position, i.e. his longitudinal axis, with the possibility for also performing simple, rapid and accurate adjustments in the patient's position in the vertical plane. FIGS. 1–4 show a solution where the support device 4 is designed as an angle lever with the axis of rotation in the vertical plane placed at the height corresponding to the patient's centre of gravity, i.e. taking into account the total weight of the patient and the operating table. Thus in FIG. 1 the support device is designed as an angle lever 8 in the top of which is placed a horizontal axis of rotation 9 which connects the angle lever 8 with a further angle lever 10, in which the ring's rotating mounting 3 is installed. In FIGS. 2–4 the angle lever 10 is designed in a rather different way to the solution illustrated in FIG. 1, but works according to the same principle. In both cases part 10 of the support device is placed outside the column 1, as is particularly clearly illustrated in FIGS. 2–4, thus making it possible to turn the rotatable part of the support device with the ring arrangement and the patient on the bed through 360 degrees.

This can be performed in both directions and by placing the axis of rotation in the same plane as the centre of gravity of the patient with bed, it will be possible to perform this rotation without great effort and the patient can be kept in any required position. If, e.g., the patient becomes nauseous during an operation he can be quickly tilted forward in order to overcome the nausea and then returned to the required basic position. Another important factor in this connection is that the patient can be turned all the way round and thus very easily transferred to a hospital bed which is wheeled in under the operating table. The potential for making such transfers is of enormous importance and saves the personnel from having to perform extremely heavy lifts which also have to be carried out with great care on a newly operated patient. When such transfers are made on half of the ring naturally has to be removed in advance. Another possible alternative involving this potential of being able to turn through 360 degrees is to place the patient directly in a chair or lift the patient from a chair whose base has been arranged at an angle, thus placing the patient in a sitting position in advance. A patient can also be placed on the table from a standing position. The special rotational possibilities in accordance with the invention thus result in a considerable simplification of the handling of patients who have to be kept as still as possible.

Figure 15:
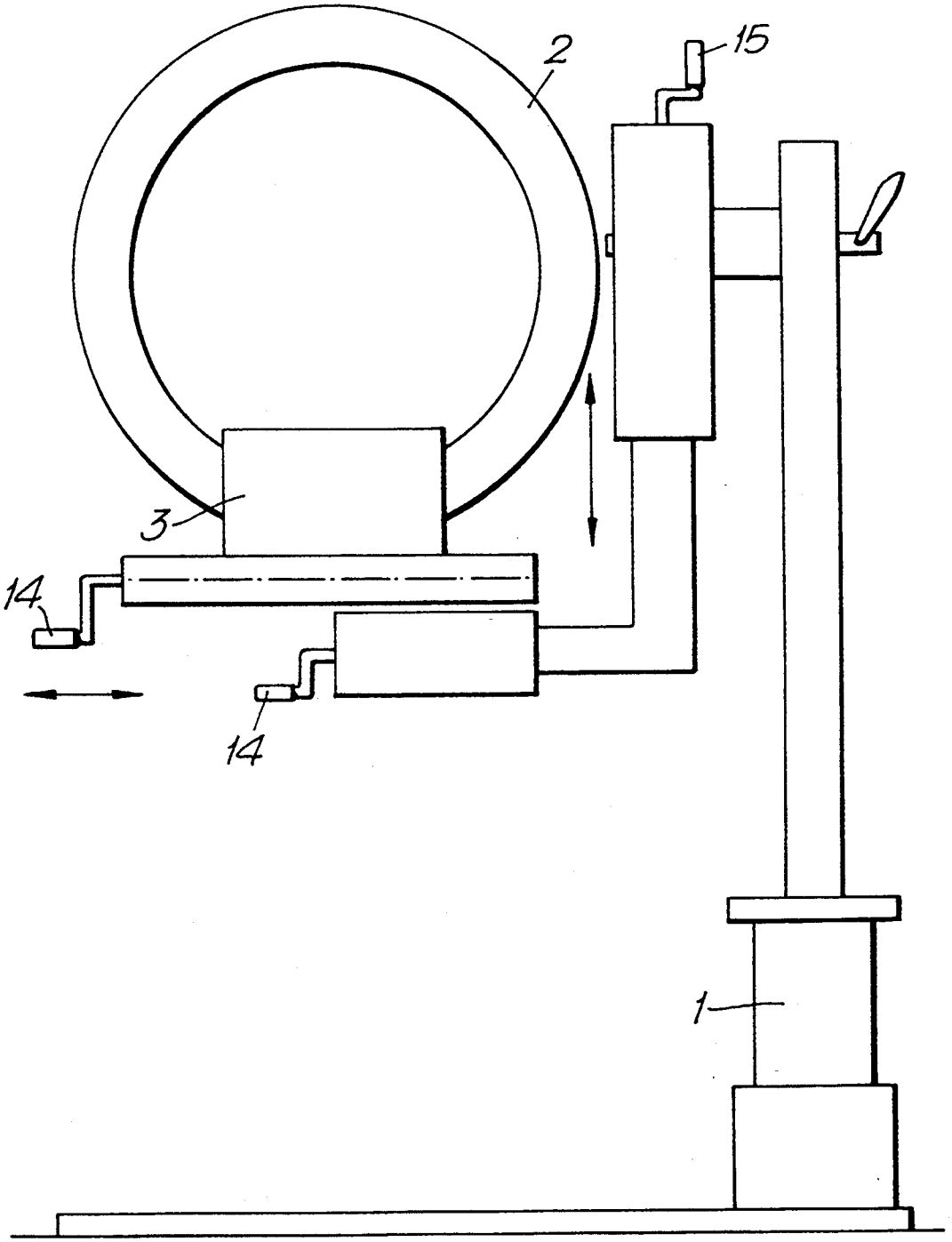

If it is necessary for the column of the operating table to be located under the bed during the operation, the arm constructions can easily be equipped with a shifting mechanism 14 for transfer of the ring 2 with its mounting 3 in a horizontal position, after having lifted the ring to a sufficient height above the column with a vertical shifting mechanism 15. This vertical shifting mechanism can also be used to adjust the axis of rotation for vertical rotation at the height of the axis of rotation 9, i.e. as a centre of gravity adjustment. The fitting of such adjustment mechanisms is illustrated schematically in FIG. 15 and can be used together with most solutions.

Figure 5:
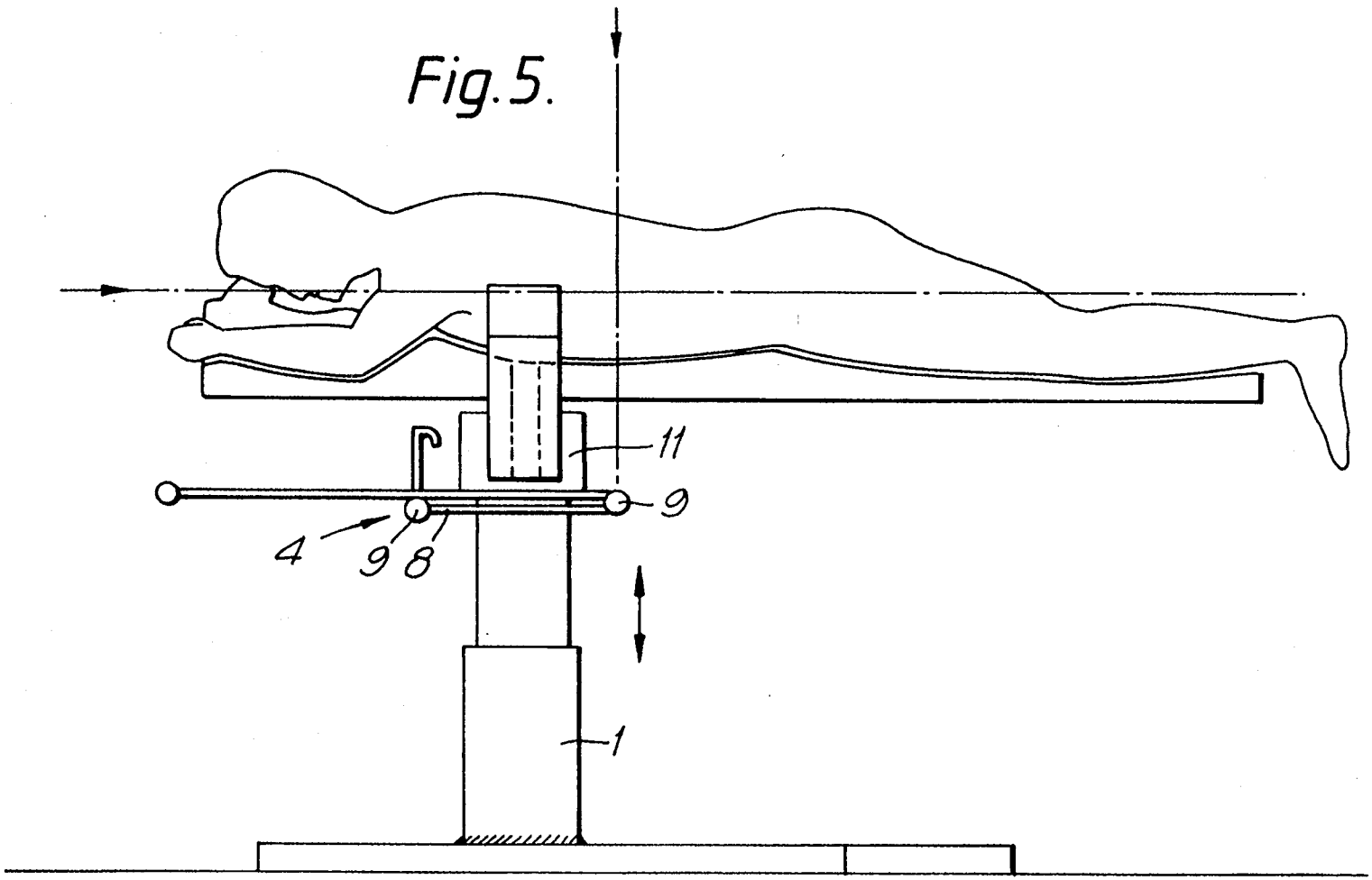

FIG. 5 and FIGS. 6 and 7 illustrate another embodiment of the invention, and particularly the support device 4. FIG. 6 illustrates how one half of the ring, bed A in the example shown can be lifted up or placed in position, after which the patient can be rotated to the position illustrated in FIG. 7, and the bed B removed. The bed is adapted to the human form, thus giving good support during the rotation.

Figure 10:
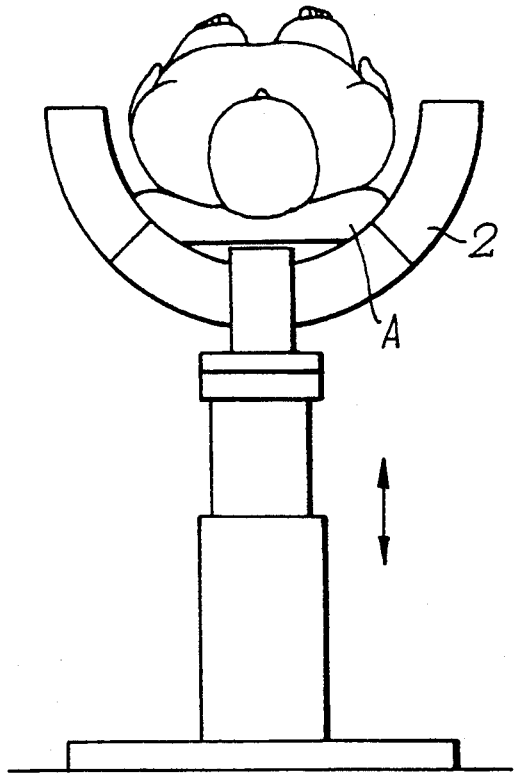
Figure 8:
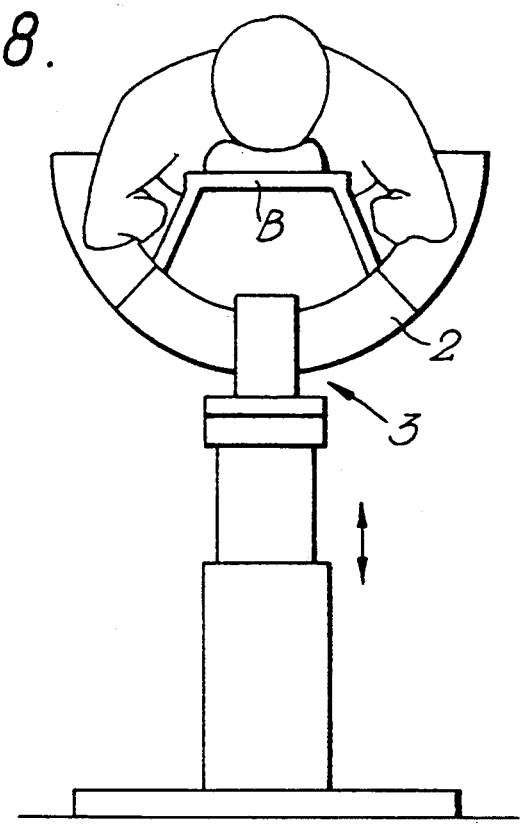
Figure 9:
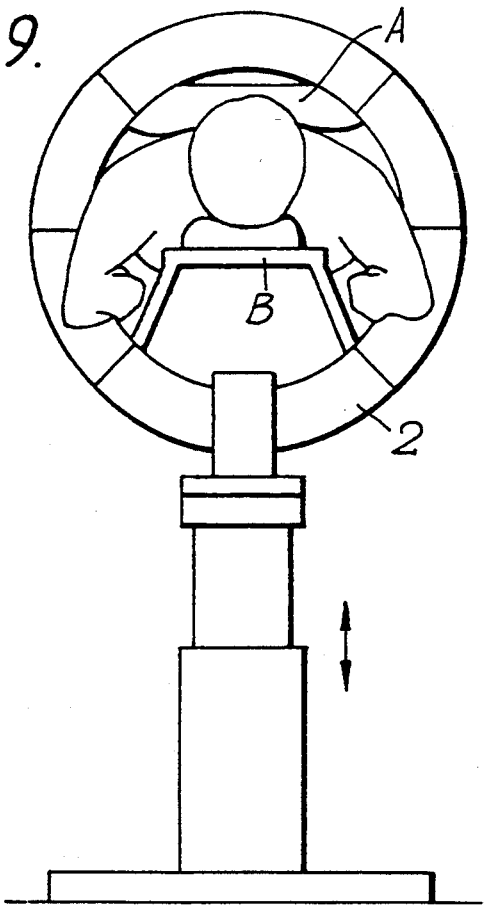

FIG. 5 illustrates a design of the support device where the horizontal axis of rotation for turning the patient in the vertical plane is placed lower, but still in the same area as the patient's vertical centre of gravity. In this case too the part of the support device which is indicated hereby 11, and which corresponds to the angle lever 10, can be placed beside the column 1, thus enabling rotations of 360 degrees to be performed in both directions. In this case, however, greater effort is required and this solution is mainly envisaged for simpler versions of the operating table, where only a small angle of rotation of approximately 90 degrees is required to transfer the patient to a lower-lying stretcher, a standing position, etc. Two rotating bearings can also be used as indicated in FIG. 5 in order to tilt the patient in both directions, i.e. plus 90 degrees and other similar angles. In such a case the support device part 11 can also be placed immediately above the column, as illustrated in FIGS. 8–10. The same rotational possibilities are also available as in the above-mentioned example.

Figure 13:
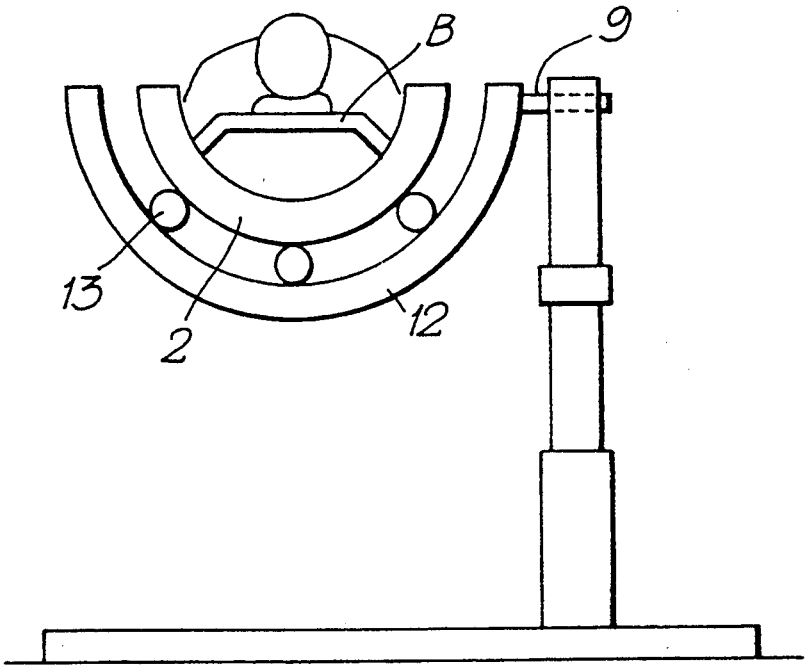
Figure 14:
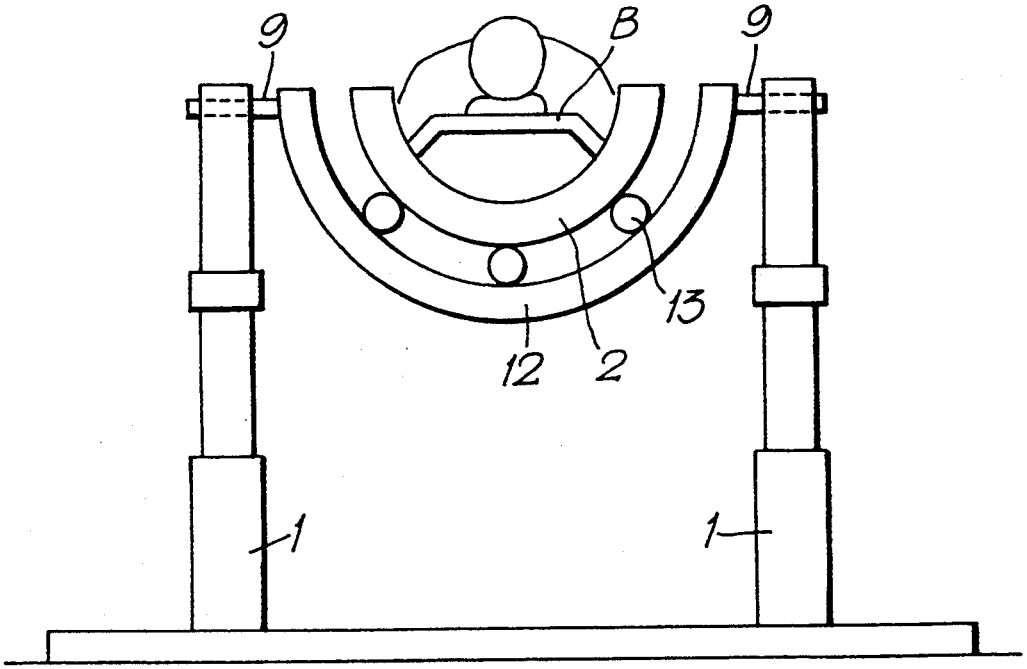

Finally, two further embodiments are illustrated in FIGS. 13 and 14, where instead of an angle lever, a cradle-like support device has been attached to the horizontal axis of rotation 9, where the ring 2 can turn, e.g. on the roller bearing 13. A variant of this solution is shown in FIG. 14 where two support columns 1 are used between which a cradle arrangement as illustrated in FIG. 13 is mounted in a rotatable manner. In this case too the beds and the patient can be rotated through 360 degrees in the vertical plane.

It will be obvious from the above that many modifications are possible within the scope of the invention. The major advantages provided by the invention comprise amongst others the possibility of making fine adjustments in the patient's position both in the horizontal and vertical planes, the possibility of adjustment of the patient's position and transfer of the patient to or from a stretcher, chair or bed with relatively little effort and without having to move the patient more than is absolutely necessary.

I claim:

1. An operating table, comprising;

a telescopic supporting column (1);

a support device (4) which is operatively mounted on the telescopic supporting column, the support device (4) comprising a vertically rotatable device and a rotating mounting means (3), operatively coupled to the vertically rotatable device, for holding a divisible, rotatable ring means (2) for mounting one above the other two beds (A, B) for a patient to lie on such that the two beds with their support device (4) can be rotated, the vertically rotatable device having an axis of rotation which is on approximately the same vertical plane as the centre of gravity of the rotatable ring means (2) which includes the bed and the patient.

2. The operating table of claim 1 wherein the rotatable ring means (2) is located beside the supporting column (1).

3. The operating table of claim 2 wherein the vertically rotatable device comprises a cradle which is rotatably attached to at least one supporting column (1) with a horizontal axis of rotation which is mounted at a height corresponding to the centre of gravity of the operating table with a patient, and wherein the rotatable ring means (2) is mounted on the roller bearing in the cradle.

4. The operating table of claim 1 wherein the vertically rotatable device (4) comprises an angular arm (10), on which the rotating mounting means (3) is located in the outer area of a projecting part of the arm (10).

5. The operating table of claim 4 wherein one of the beds is in the form of a carapace.

6. The operating table of claim 1 wherein at least one of the two beds (A, B) is designed with joints at the hip and knee sections and wherein each bed is designed to fit the shape of the patient.

7. The operating table of claim 1 wherein the rotatable ring means (2) comprises two parts mated together such that extension pieces may be fitted between the two parts.

8. The operating table of claim 1 further comprising means for moving the rotatable ring means (2) with the rotating mounting means (3) mounting in the horizontal direction.

9. The operating table of claim 1 further comprising means for moving the rotatable ring (2) with the rotating mounting means (3) mounting in the vertical direction.

* * * * *